United States Patent [19]

Larsen

[11] 4,246,572

[45] * Jan. 20, 1981

[54] DETECTION CIRCUIT WITH HYSTERESIS

[75] Inventor: Larry D. Larsen, Elgin, Ill.

[73] Assignee: Patent Development & Management Company, Elgin, Ill.

[ * ] Notice: The portion of the term of this patent subsequent to Apr. 4, 1995, has been disclaimed.

[21] Appl. No.: 890,289

[22] Filed: Mar. 27, 1978

Related U.S. Application Data

[63] Continuation-in-part of Ser. No. 638,843, Dec. 8, 1975, Pat. No. 4,083,037.

[51] Int. Cl.[2] ..... G08B 17/10

[52] U.S. Cl. ..... 340/501; 250/381; 340/629; 340/661

[58] Field of Search ..... 340/629, 628, 514, 515, 340/660, 661; 250/381

[56] References Cited

U.S. PATENT DOCUMENTS 4,083,037 4/1978 Larsen ..... 340/629

*Primary Examiner*—John W. Caldwell, Sr.
*Assistant Examiner*—Daniel Myer
*Attorney, Agent, or Firm*—Dulin, Thienpont & Potthast

[57] ABSTRACT

A battery-powered fire alarm including a smoke detector circuit, a controllable horn circuit and a battery monitoring circuit. The smoke detector employs a pair of complementary field-effect transistor switches with gates respectively connected to an ionization chamber and a potentiometer of a Wheatstone bridge circuit connected across the battery. The field-effect transistors are biased off to minimize standby power consumption and are connected such that the threshold voltages thereof are offsetting to minimize supply voltage sensitivity of the detector. When the voltage from the ionization chamber assumes a value approximately equal to a preselected alarm voltage at the potentiometer, both field-effect transistors turn on to energize an alarm circuit to sound an alarm. Hysteresis circuitry is provided to ensure that the complementary switches, once turned on, will not turn off and thereby terminate the alarm until after the alarm condition has terminated. In one embodiment, a feedback signal causes the preselected alarm voltage to increase in response to alarm activation. In other embodiment, hysteresis is achieved by means of a feedback signal proportionately lowering the sensing voltage from the ionization chamber in response to alarm activation. A test switch and associated circuitry is also provided to manually lower the sensing voltage below the preselected alarm voltage to test the detection circuitry in addition to the battery and alarm horn.

9 Claims, 2 Drawing Figures

DETECTION CIRCUIT WITH HYSTERESIS

CROSS REFERENCE TO RELATED APPLICATION

This application is a continuation-in-part of my copending application Ser. No. 638,843, filed Dec. 8, 1975, entitled "Detection Circuit" which has now issued as U.S. Pat. No. 4,083,037.

BACKGROUND OF THE INVENTION

This invention relates to a smoke-detecting fire alarm and, more particularly, to an alarm of this type having hysteresis circuitry to ensure an alarm until the alarm condition has ended and a manually actuatable test circuit.

Smoke-sensing fire alarms which sense the change in impedance of an ionization chamber when smoke is introduced thereto are well known. Typically, an open ionization chamber is connected in a voltage divider circuit across a power source and a change in impedance is reflected in a voltage change thereacross. This sensing voltage is monitored by a detection circuit and when it exceeds a preselected alarm level, the detection circuit energizes a suitable alarm circuit. In self-contained, i.e., battery-powered, fire alarms of this type, it is known to provide a battery monitoring circuit which will cause a low battery signal to be generated when the battery has been depleted beneath a level at which successful operation of the alarm circuit is assured.

It is desirable that once the alarm is sounded, it continues to sound until after the condition causing the alarm has terminated. The alarm condition is often represented by an electrical detection signal generated by the circuit exceeding a preselected detection level. One way of ensuring that the alarm remains on until after termination of the alarm condition is to require manual reset or turn-off of the alarm. This, however, may result in unnecessary alarm and depletion of the battery powering the unit due to relative inaccessibility of the alarm for manual reset. On the other hand, if the alarm is designed to automatically turn off at the same preselected detection level of the electrical detection signal which causes the alarm to turn on, electrical or physical transients may cause the alarm to turn off even though the alarm condition has not ended.

It is of utmost importance that the detector be maintained in an operative condition. Accordingly, it is known to provide a manually actuatable test switch and associated circuitry to enable the user to easily test the detector for operability. One type of testing circuitry is shown in U.S. Pat. No. Re. 28,915 in which closure of a test switch causes the application of battery power to an audio horn. Unfortunately, while this tests both the horn and the battery, a positive test result does not necessarily indicate operability of the detection circuit.

SUMMARY OF THE INVENTION

An important object of the present invention is to provide a detection circuit with a hysteresis characteristic to ensure that once the alarm is actuated in response to an alarm condition, it will not be turned off prematurely in response to physical or electrical transients. In the preferred embodiments, the detection circuit causes an alarm to be sounded when a sensing voltage decreases below a preselected alarm voltage and causes the alarm to be terminated when the sensing voltage increases above the preselected alarm voltage. The desired hysteresis characteristic is achieved in one of the embodiments through a feedback circuit causing the preselected alarm voltage to increase above its normal value in response to alarm. In another embodiment, hysteresis is achieved by means of a feedback circuit causing the sensing voltage to be proportionately lowered in response to alarm activation.

Another object is to provide a manually operable circuit for testing operability of both the detection circuitry itself in addition to the alarm horn and battery. In the preferred embodiment, this is achieved by electrically simulating an alarm condition.

Further objects, features and advantages will be made apparent and the foregoing objects, features and advantages will be described in more detail in the description of the preferred embodiment.

BRIEF DESCRIPTION OF THE DRAWING

The following description of the preferred embodiment is given with reference to the drawing in which.

DESCRIPTION OF THE PREFERRED EMBODIMENT

Figure 1:
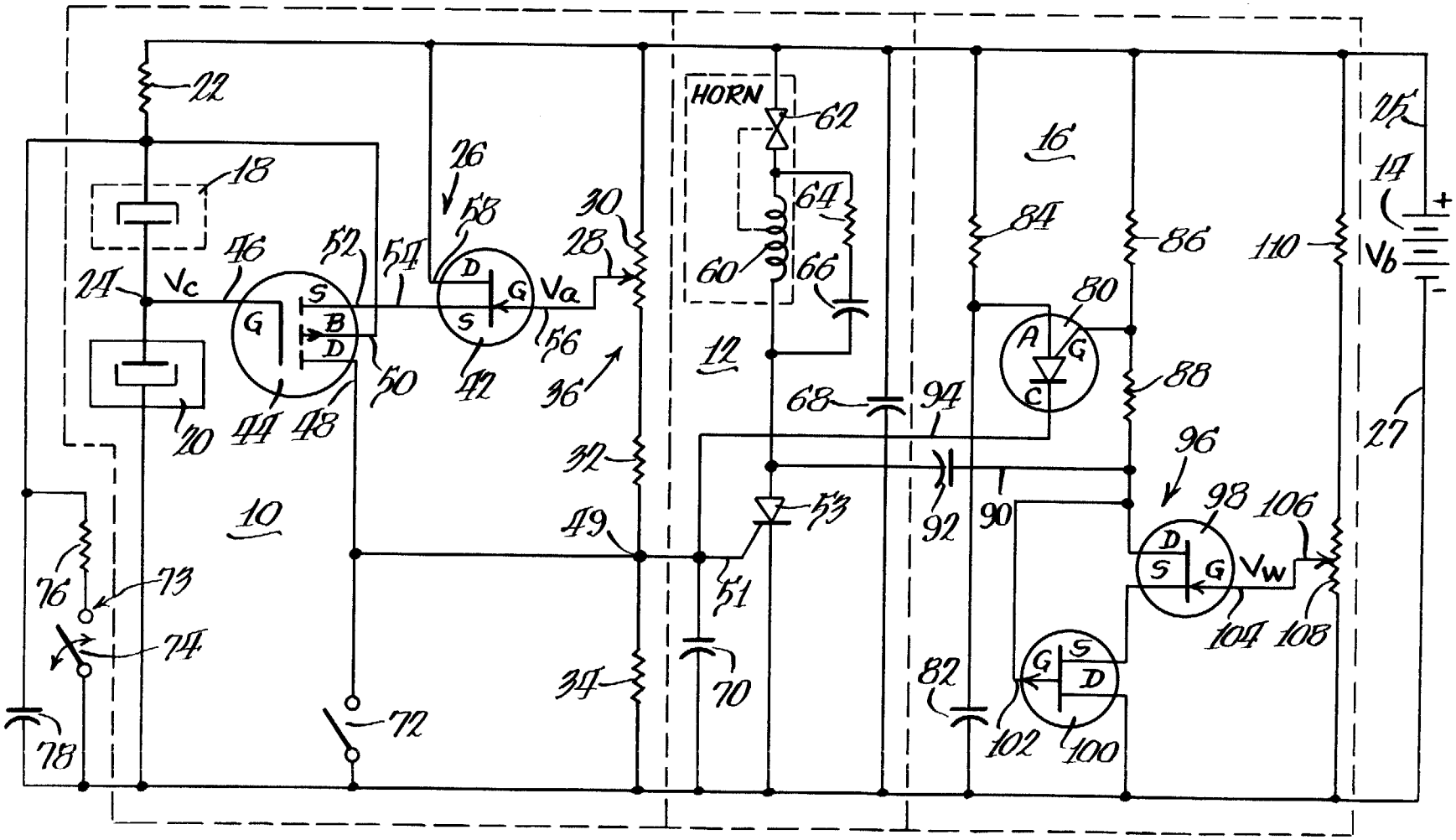
FIG. 1 is a schematic of one embodiment of the smoke-sensing fire alarm constructed in accordance with the present invention.

Referring to FIG. 1, one embodiment of the smoke-detecting fire alarm of the present invention is seen to include a detection circuit 10, a controllable horn circuit 12 for providing an audible alarm, a battery 14 providing a power supply voltage $V_b$, and a battery monitoring circuit 16. The detection circuit 10, upon sensing a fire alarm condition, causes horn circuit 12 to generate a continuous audible alarm. The battery monitoring circuit 16, upon sensing a fire alarm condition, causes horn circuit 12 to generate a continuous audible alarm. The battery monitoring circuit 16, upon sensing a selected low voltage condition of battery 14, causes the horn circuit 12 to generate an intermittent audible signal.

The detection circuit employs a pair of conventional ionization chambers 18 and 20 connected in series across battery 14 through a resistor 22. Ionization chambers 18 and 20 thus define a voltage divider which produces a sensing voltage $V_c$ at a junction 24 between chambers 18 and 20 which is a function of the relative impedance values thereof. Chamber 20 is closed while chamber 18 is open to ambient air to permit the entry therein of smoke and other gases from a fire.

The entry of smoke into the open chamber 18 causes its impedance to increase while the impedance of the closed chamber 20 is unaffected. The positive terminal 25 of battery 14 is connected to chamber 18 and the negative terminal 27 in connected to chamber 20. Consequently, the fire-induced increase in impedance of open chamber 18 causes the sensing voltage $V_c$ to decrease.

The chambers 18 and 20 are matched with respect to their other characteristics, such as their temperature coefficient, so that other changes in the environment affecting the chambers will produce offsetting changes in the chambers and will not alter the sensing voltage $V_c$. The impedances of both chambers are on the order of hundreds of thousands of megohms so that little drain is imposed on the battery 14 thereby. While different relative impedance values for the ionization chambers will work, relative values which produce, in the absence of smoke, a sensing voltage $V_c$ equal to 0.6 times the battery voltage $V_b$ have been found suitable.

The sensing voltage $V_c$ is compared by a voltage-responsive switching circuit 26 which a preselected alarm voltage $V_a$ developed at the wiper blade output 28 of a potentiometer 30. When the sensing voltage $V_c$ decreases to a value substantially equal to the alarm voltage $V_a$, the switching circuit energizes the horn circuit 12 to sound a continuous alarm.

Potentiometer 30 is connected in series with two fixed resistors 32 and 34 across battery 14 to form a variable voltage divider 36. The voltage divider has a resistance in the megohm range to minimize drain on the battery 14. The variable voltage divider 36, taken with the voltage divider formed by ionization chambers 18 and 20, defines a Wheatstone bridge circuit. Consequently, changes in the sensing voltage $V_c$ due to fluctuations in battery voltage $V_b$ are offset by like changes effected in the alarm voltage $V_a$. This minimizes sensitivity of the switch circuit 26 to fluctuations of battery voltage $V_b$. The fact that the voltage-controlled switch 26 turns on when the bridge is approximately balanced further minimizes supply voltage sensitivity and imposes stability.

The wiper blade output 28 is positioned to establish a value for alarm voltage $V_a$ less than that of the quiescent value of the sensing voltage $V_c$. By varying the position of the wiper blade output 28, the sensitivity may be selectively varied. A value of 0.5 $V_b$ for the alarm voltage $V_a$ has been found suitable when the quiescent value of the sensing voltage $V_c$ is 0.6 $V_b$ for a battery voltage of 9 volts.

Switching circuit 26 comprises an N-channel silicon junction field-effect transistor or J-FET 42 and a P-channel enhancement-type silicon MOS field-effect transistor or MOS FET 44. MOS FET 44 has its gate 46 connected to junction 24. The output of switch 26 is taken from the drain 48 of MOS FET 44 and connected to gate 51 of an SCR 53 of controllable horn circuit 12. The substrate 50 is connected to the positive battery terminal 25 through current limiting resistor 22. The source terminal 52 of MOS FET 44 is connected to the source terminal 54 of J-FET 42. J-FET 42 is in a source follower configuration with its gate 56 connected to the wiper output 28 of variable voltage divider 36 and its drain 58 connected to the positive battery terminal 25.

Both MOS FET 44 and J-FET 42 are biased off to minimize current drain on battery 14, and turn on only when the sensing voltage $V_c$ decreases to a value approximately equal to the alarm voltage $V_a$. When this occurs, both MOS FET 44 and J-FET 42 turn on, and drain current from MOS FET 44 is applied to the gate 51 of SCR 53 which turns on in response thereto.

The MOS FET 44 functions both as a high impedance buffer between the SCR 53 and the sensing circuit of ionization chambers 18 and 20 and as a threshold switching device. The MOS FET 44 turns on when the gate-to-source threshold voltage is exceeded. The sensing voltage at which this occurs may be selectively varied through control of wiper blade output 28. The position of wiper blade output 28 establishes the voltage at source 52 and thereby the magnitude of the sensing voltage $V_c$ at which the threshold voltage of MOS FET 44 is exceeded. Consequently, MOS FETS with differing threshold characteristics may be used for alarms sounding at the same voltage and the cost of manufacturing reduced.

The high input and low output impedance of the J-FET 42 provides impedance matching between the voltage divider 36 and the MOS FET 44. In addition, the changes in the gate-to-source voltage or $V_{gs}$ of the MOS FET 44 due to temperature changes is offset by changes of opposite sense in the $V_{gs}$ of the J-FET and vice versa.

The complementary arrangement of MOS FET 44 and J-FET 42 also maximizes supply voltage independence of the detection circuit. This is because both MOS FET 44 and J-FET 42 turn on when the bridge is approximately balanced and the point of balance is established solely by the relative impedance values of the legs of the bridge and is completely independent of the supply voltage.

In keeping with one of the objects of the invention, the detection circuit is provided with a hysteresis characteristic to ensure that once horn circuit 12 is activated in response to an alarm condition, it will not be turned off inadvertently due to physical or electrical transients. In the embodiment of FIG. 1, the drain 48 of MOS FET 44 is connected with junction 49 of voltage divider 36 to provide hysteresis to switching circuit 26 of FIG. 1. When MOS FET 44 and J-FET 42 turn on, a relatively low impedance shunt is applied across resistors 30 and 32, such that the alarm voltage $V_a$ at wiper output 28 increases slightly above its value when MOS FET 44 and J-FEt 42 are off. Thus, the sensing voltage $V_c$ at junction 24 must increase to a value greater than the value at which MOS FET 44 and J-FET 42 were turned on before they will turn off.

Figure 2:
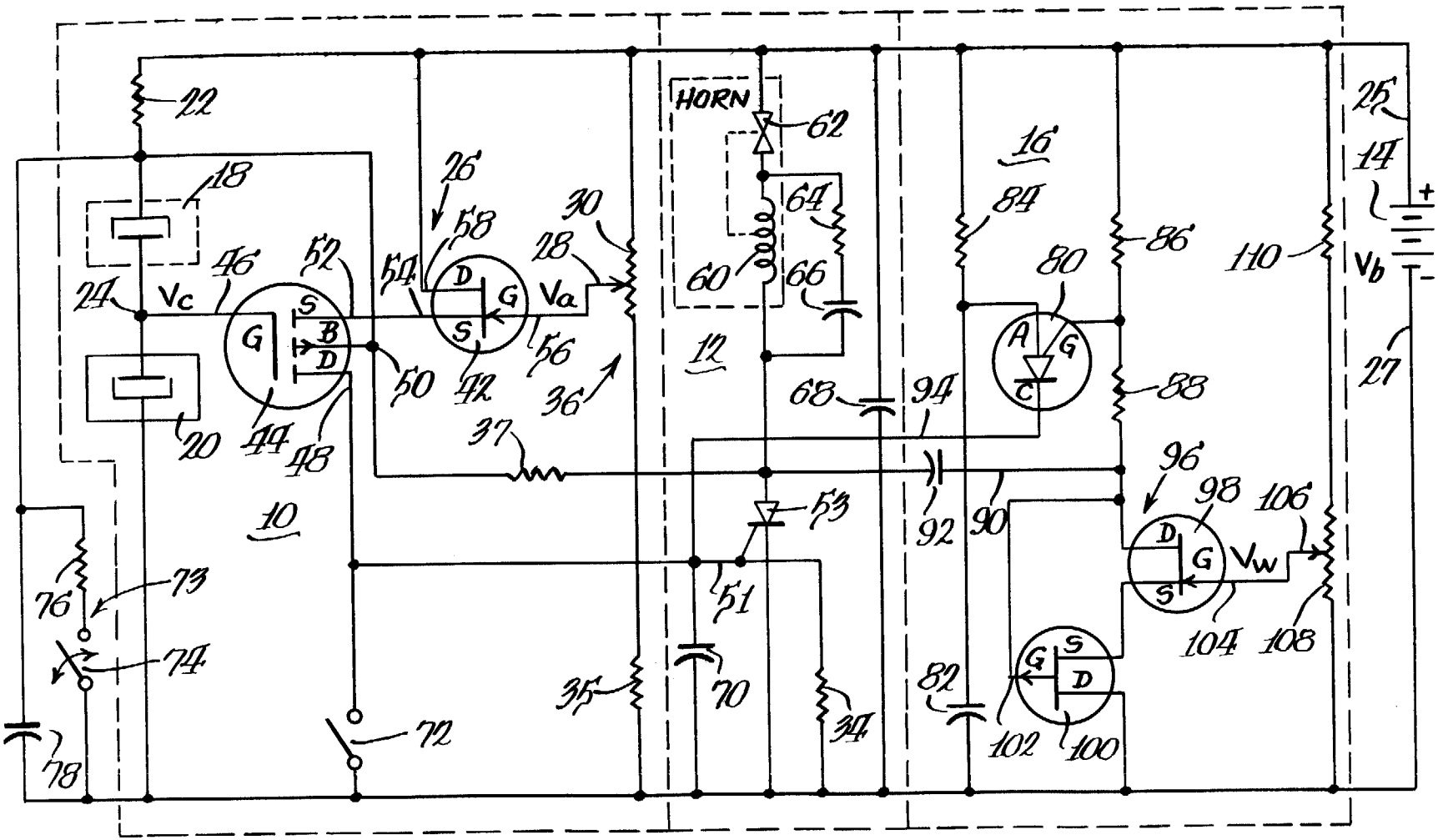
FIG. 2 is a schematic of another embodiment having a hysteresis circuit different from that of FIG. 1.

The hysteresis characteristic is achieved in a somewhat different manner in the embodiment of FIG. 2. The detection circuit of FIG. 2 is identical in structure and operation to that of FIG. 1 except for the circuitry relating to the hysteresis characteristic. Accordingly, identical circuit elements of FIGS. 1 and 2 have been given the same reference numerals, and the description of operation of the circuitry of FIG. 2 may be considered to be the same as that given for the corresponding circuitry of FIG. 1.

With respect to the hysteresis characteristic, the junction 49 connecting potentiometer resistor 30 with drain 48 of MOS FET 44 of FIG. 1 has been deleted in favor of a resistor 37 connecting the anode of SCR 53 with the junction between resistor 22 and sensing chamber 18.

Further, resistors 32 and 34 of FIG. 1 have been replaced by a single resistor 35 connected between the negative battery terminal 27 and potentiometer resistor 30. The resistance value of resistor 35 is approximately equal to the sum of resistors 32 and 34. The value of resistor 37 is selected in accordance with the amount of hysteresis desired.

When SCR 53 is turned on in response to MOS FET 44 and J-FET 42 turning on, resistor 37 is connected across the series connection of chambers 18 and 20 through SCR 53. This causes the voltage at the junction of resistor 22 and chamber 18 to decrease. The sensing voltage $V_c$ is proportional to the voltage at the junction of resistor 22, and, accordingly, the sensing voltage is decreased proportionately. As a result, the amount that the sensing voltage $V_c$ must increase due to decrease in the impedance of closed chamber 20 before it exceeds the alarm voltage $V_a$ is enlarged, and hysteresis is achieved.

As stated, when drain current is applied to the gate 51 of SCR 53, SCR 53 turns on to energize the horn circuit 12. A filter capacitor 70 is connected between the gate 51 of SCR 53 and its cathode and resistor 34 provides suitable gate bias for SCR 53. Horn circuit 12 is conventional and includes a relay coil 60 connected in series between the anode of SCR 53 and a pair of relay contacts 62 operated thereby. One of contacts 62 is connected with a horn diaphragm (not shown) which vibrates to generate the audible alarm. The horn circuit 12 also includes a series connection of a resistor 64 and capacitor 66 connected across coil 60 and a starting capacitor 68 connected across battery 14.

SCR 53 turns off as soon as contacts 62 open after gate drive to SCR 53 has been removed. Gate drive is removed through closure of a normally open disable switch 72 connected between the gate 51 and the cathode of SCR 53. The disable switch 72 is spring biased to an open position and will remain closed only so long as it is manually held closed to prevent inadvertent, permanent disablement of the alarm. MOS FET 44 and J-FET 42 will also turn off and remove gate drive when the impedance of chamber 18 returns to a level sufficiently low to decrease the voltages thereacross below pinch-off.

A test circuit 73 is provided by a normally open switch 74 connected through a resistor 76 between negative battery terminal 27 and the junction between resistor 22 and chamber 18. Closure of switch 74 lowers the sensing voltage $V_c$ to a level less than the alarm voltage to simulate an alarm condition. Thus, unlike test circuits which only apply battery power to the horn or other alarm, test circuit 73 advantageously tests operability of detection circuit 10 in addition to horn circuit 12 and battery 14.

The battery monitoring circuit 16 includes a conventional relaxation oscillator including a programmable unijunction transistor or PUT 80 which commences oscillating when the voltage across battery 14 decreases below a preselected value established by circuitry associated with a negative resistance switch circuit 96. PUT 80 has its anode connected to a junction between a timing capacitor 82 and resistor 84 connected across battery 14. The gate of PUT 80 is connected through a resistor 86 to the positive side of battery 14 and is also connected through a resistor 88 to switch circuit 96. The output of the oscillator is taken off the cathode of PUT 80 and connected through a lead 94 to SCR gate 51. During oscillation, capacitor 82 is periodically charged through resistor 84 and discharged through PUT 80 into gate 51 to turn on SCR 53 and momentarily energize the coil 60. The reduction of voltage across capacitor 82 at the end of the discharge cycle causes PUT 80 to turn off at the end of discharge.

The value of capacitor 82 is selected so that the coil is momentarily energized at frequencies of approximately once per minute. The battery voltage level at which the relaxation oscillator is enabled to oscillate is selected so that sufficient power is available to operate the oscillator for at least seven days.

An advantageous feature of the present invention is that if the battery should become disconnected, the starting capacitor will provide enough power to energize the horn circuit 12 for one cycle of the resonant oscillator when a low battery condition is sensed by circuit 96. Accordingly, both no battery and low battery indications are provided. This feature can, of course, also be advantageously employed with a circuit powered by A.C.

The switch circuit 96 is connected between the negative side of battery 14 and the junction between resistor 88 and capacitor 92. The oscillator circuit is enabled to oscillate only when switch circuit 96 assumes a conductive state. The switch circuit 96 comprises a pair of complementary, depletion mode, field-effect transistors: an N-channel J-FET 98 and a P-channel J-FET 100. The drain-source circuit of the J-FETS 98 and 100 are connected in series with each other between the negative battery terminal 27 and the gate input of the relaxation oscillator. The gate 102 of J-FET 100 is connected to the junction between resistor 88 and the drain 103 of J-FET 98. The gate 104 of J-FET 98 receives a control voltage VL at a wiper output 106 of potentiometer 108 connected across battery 14 through a fixed resistor 110. Gate 104 of J-FET 98 is thus connected to a potential higher than that applied to its source terminal.

Both J-FETS 98 and 100 remain off until the voltage thereacross, i.e., the battery voltage $V_b$, decreases to a value less than a preselected low battery voltage VL established by the variable control voltage VL at the wiper blade output 106 and the threshold voltages of J-FETS 98 and 100. This low battery voltage is approximately equal to the sum of the threshold voltages of J-FETS 98 and 100 and the control voltage VL. Until this preselected low battery voltage is reached, the only currrent through circuit 96 is leakage current in the nanno ampere range. When the battery voltage $V_b$ across switch 96 decreases below the preselected low battery voltage VL, the current therethrough increases rapidly with small decreases in the voltage thereacross until a peak current having a corresponding peak voltage is reached. For values of voltage less than the peak voltage, the switch circuit has a positive resistance current and decreases in voltage result in a decrease of current.

The switch 96 functions in a manner similar to that of a lambda diode as described in an article entitled "The Lambda Diode: A Versatile Negative-Resistance Device", by Gota Kano et al, appearing at pages 105–109 in the June 26, 1975, issue of *Electronics*, and reference may be had thereto for a schematic illustration of the current-voltage characteristic curve. In the lambda diode, however, the voltage $V_v$ corresponding to the low battery voltage of circuit 96 is solely dictated by the threshold characteristics of the field-effect transistors. The versatility of the switching circuit 96, in which the low battery voltage $V_v$ is a function of the position of wiper blade 106, is not achieved.

When switching circuit 96 turns on, the voltage thereacross drops to a level beneath its peak voltage. A capacitor 92 connected between the anode of SCR 53 and the junction of the drain of J-FET 98 with resistor 88 provides a positive voltage feedback pulse from SCR 53 when it turns off to assist in resetting switch circuit 96 to its condition in which the voltage across switch circuit 96 is greater than the peak voltage.

The particular operating characteristics of a circuit constructed in accordance with the present invention is, of course, dependent upon the particular characteristics and values of the various components which are used. In addition, implementation in integrated circuit form may require different but equivalent circuitry and different values. However, a circuit built in accordance with the schematic of FIG. 1 and using the below-identified chart elements has been found to operate in a suitable manner:

| Ref. No. | Description | Characteristic | Trade Designation |
|---|---|---|---|
| 14 | battery | Alkaline 9v | |
| 18 | ionization chamber | $300 \times 10^{+15}$ ohms | |
| 20 | ionization chamber | $300 \times 10^{+15}$ ohms | |
| 22 | resistor | 100 Kohm | |
| 30 | potentiometer | 1 Mohm | |
| 32 | fixed resistor | 1 Mohm | |
| 34 | fixed resistor | 5.1Kohm | |
| 42 | J-FET | | Siliconix Inc. E211 |
| 44 | MOS FET | | General Instrument Inc. - 3N163 |
| 53 | SCR | | General Electric C106 |
| 60 | coil | 9 volt Kobishi | |
| 64 | resistor | 100 ohms | |
| 66 | capacitor | .1 microfarad | |
| 68 | starting capacitor | 330 microfarad | |
| 70 | capacitor | .01 microfarad | |
| 76 | resistor | 470Kohm | |
| 78 | filter capacitor | .01 microfarad | |
| 80 | PUT | | Nippon Electric N13T2 |
| 82 | timing capacitor | 15 microfarad | |
| 84 | resistor | 4Mohm | |
| 86 | resistor | 100Kohm | |
| 88 | resistor | 220Kohm | |
| 92 | capacitor | .01 microfarad | |
| 98 | J-FET | | Siliconix Inc. E211 |
| 100 | J-FET | | Siliconix Inc. E270 |
| 108 | potentiometer | 1Mohm | |
| 110 | fixed resistor | 1 Mohm | |

Because of the various advantageous features of the detection circuit, the total battery current in standby is less than 10 microamperes and the circuit will successfully operate for one year on a single battery of the above-identified type before a low battery indication is provided.

I claim:

1. In a detection circuit having means for generating a sensing signal which varies in accordance with a phenomenon being sensed, means for establishing an alarm reference signal, and means for generating an output signal in response to the sensing signal exceeding the alarm reference signal in one sense and terminating the output signal in response to the sensing signal exceeding the alarm reference signal in an opposite sense, a hysteresis circuit, comprising:

means responsive to the output signal for developing a feedback signal; and means responsive to said feedback means for altering one of said sensing signal and said alarm reference signal to establish a hysteresis characteristic for said detection circuit, said detection circuit terminating generation of said output signal at a level of the phenomenon being sensed less than the level at which said output signal is initially generated.

2. The hysteresis circuit of claim 1 in which said phenomenon being sensed is the products of combustion.

3. The hysteresis circuit of claim 1 in which said altering means comprises means for changing the magnitude of the alarm reference signal in response to generation of said output signal.

4. The hysteresis circuit of claim 3 in which said magnitude changing means varies the magnitude of the alarm reference signal in said opposite sense.

5. The hysteresis circuit of claim 4 in which said magnitude changing means causes the magnitude of the alarm reference signal to increase to a value greater than its value when the output signal is generated in response to phenomenon detection.

6. The hysteresis circuit of claim 1 in which said altering means includes means for altering the sensing signal in response to generation of the output signal.

7. The detection circuit of claim 1 in which the output signal generating means includes, a pair of complementary voltage-responsive switches each having a pair of transconductive terminals and a control terminal and being switchable between conductive and non-conductive states, a source of power, means for connecting the transconductive terminals in series across the power source, means for applying the alarm reference signal to the control input of one of said switches, means for applying the sensing signal to the control input of the other of said pair of complementary switches, both of said switches being biased in a non-conductive state and both of said switches assuming a conductive state when the sensing signal assumes a value substantially equal to that of the alarm reference signal, and means responsive to said switches assuming a conductive state for providing an indication of detection; and said altering means includes hysteresis establishing means responsive to said switches assuming conductive states for varying the voltage at the control input of one of said one switch and the other switch in a sense for establishing hysteresis for said switches.

8. The detection circuit of claim 7 in which said hysteresis establishing means includes means for changing the sensing voltage at the control input of said other switch.

9. The detection circuit of claim 8 in which said detection indicating means includes an alarm device and a switch for controlling application of power to the device, said switch assuming a state to apply power to the device in response to said complementary switches assuming conductive states, and said hysteresis establishing means includes impedance means connecting said switch to said sensing element.

* * * * *